US005137444A

United States Patent [19]

Grebe et al.

[11] Patent Number: 5,137,444

[45] Date of Patent: Aug. 11, 1992

[54] PROCESS FOR OPERATING A BURNER FED WITH LIQUID FUEL

[75] Inventors: Karl Grebe, Starnberg; Karl Panick, Planegg, both of Fed. Rep. of Germany

[73] Assignee: Webasto AG Fahrzeugtechnik, Stockdorf, Fed. Rep. of Germany

[21] Appl. No.: 692,231

[22] Filed: Apr. 26, 1991

[30] Foreign Application Priority Data

May 3, 1990 [DE] Fed. Rep. of Germany ..... 4014185

[51] Int. Cl.[5] ..... F23C 11/04

[52] U.S. Cl. ..... 431/1; 431/3; 431/12; 126/110 B

[58] Field of Search ..... 431/3, 12, 86, 87, 1, 431/29, 30, 31; 126/110 B

[56] References Cited

U.S. PATENT DOCUMENTS

| | | | |
|---|---|---|---|
| 2,594,206 | 4/1952 | Payne | 431/20 |
| 3,078,838 | 2/1963 | Broecker | 126/110 R |
| 3,092,095 | 6/1963 | Hottenroth et al. | 126/110 R |
| 4,471,754 | 9/1984 | Galtz | 126/110 B |
| 4,931,011 | 6/1990 | Reiser et al. | 431/3 |

FOREIGN PATENT DOCUMENTS

| | | |
|---|---|---|
| 3822899 | 1/1990 | Fed. Rep. of Germany . |
| 2036291 | 5/1979 | United Kingdom . |

*Primary Examiner*—Carroll B. Dority
*Attorney, Agent, or Firm*—Sixbey, Friedman, Leedom & Ferguson

[57] ABSTRACT

A process for operating a burner fed with liquid fuel, in particular a vaporization burner of a heater in which, preferably, a motor vehicle add-on heater is involved. In this operating process, after the burner has been in steady state operation for a predetermined period, the fuel feed is briefly interrupted. The predetermined period of steady state operation of the burner is preferably about 5 to 20 minutes, while the fuel feed is interrupted for about 5 to 25 seconds. With this operating process, deposits on the burner can be reduced so that the service life of the burner can be considerably increased.

14 Claims, 2 Drawing Sheets

PROCESS FOR OPERATING A BURNER FED WITH LIQUID FUEL

BACKGROUND OF THE INVENTION

The invention relates to a process for operating a burner fed with liquid fuel, in particular a vaporization burner of a heater with an operations control device, such as a motor vehicle heater, in which combustion air and fuel are conveyed to the burner, optionally pulse fed by a feed and metering pump to produce an ignitable combustible mixture.

In air heaters (i.e., heaters in which air is used as a gaseous heat transfer medium) or in water heaters (in which water or another liquid coolant is used as a liquid heat transfer medium), combustion air and fuel are mixed in a burner to produce an ignition-prone combustible mixture that is burned to produce a flame in a combustion chamber. Hot combustion gases result which transfer their heat, by a heat exchanger, to the liquid or gaseous heat transfer medium. To supply fuel to the burner, a metering and feed pump can be used, for example, an electromagnetically controlled reciprocating pump. Such a pump delivers a pulsed fuel stream to the burner. This pulsed fuel stream can be equalized in the area of the burner, such as a vaporizing burner, so that an almost steady fuel feed amount is obtained.

A process for operating a heater is known from German Offenlegungsschrift 38 22 899 in which the heater can be operated in at least two load stages, a partial load stage and a full load stage. With this process, the procedure is such that the burner operation of the heater is always started in the lower or lowest load stage, and then a switching to the respectively next higher or highest load stage follows. In the respective steady state operating ranges, such as partial load and/or full load, fuel is constantly fed to the burner by the appropriate fuel feed and metering pump.

Tests have shown that, especially with vaporization burners in the steady operating states, such as full load or partial load, there is an increased tendency to form coke deposits and toward carbonization of the vaporizing element of the burner which leads to failure of the burner. After such a burner failure, the heater must be serviced, and usually the whole vaporization burner must be replaced. Especially during prolonged steady operating phases of the burner, a clogging of the vaporizing element due to carbonization is to be expected, and the deposits formed in the burner in the course of it can be reduced to an insufficient extent during non-steady operating phases, such as starting, stopping, switching.

A process for starting and operating a heating burner, in particular for motor vehicle heating, is known from German Patent 31 36 792 in which the stream of combustion air is fed intermittently in the starting phase after a period of being fed continuously, and preferably, the feeding of the fuel is interrupted, during the intermittent feeding of the stream of combustion air, until the burner ignites. By this method, the glow plugs are effectively prevented from becoming cold in the start-up phase, which is especially important when rod glow plugs are used that do not reach the high surface temperatures of coil glow plugs.

A fuel supply arrangement is known from German Offenlegungsshrift 14 51 389 in which the fuel conveyed by a diaphragm pump to the vaporization burner is reduced, since the fuel requirement of vaporization burners requires only a fraction of the amount that is supplied by the diaphragm pump used as a metering and feed pump. To reduce the fuel conveyed by the diaphragm pump, a device is provided that periodically interrupts the liquid stream. With the help of this device, the fuel amount fed to the vaporizing burner is thus throttled, but the fuel amount in the respective operating states of the burner and of the heater is continuously fed to the burner. Thus, the above-described difficulties also arise with this vaporizing burner.

SUMMARY OF THE INVENTION

The primary object of the present invention is to provide a process for operating a burner fed with liquid fuel, in particular a vaporization burner of a heater, such as a motor vehicle heater of the above-mentioned type, in which the service life can be extended without substantial breakdown of the burner, while overcoming the above-described difficulties.

According to the invention, a process for operating a burner fed with liquid fuel, in particular a vaporization burner of a heater such as a motor vehicle heater having an operations control device, in which combustion air and fuel are conveyed to the burner, optionally pulsed, by a feed and metering pump to produce an ignitable combustible mixture, is improved so as to reduce deposits formed in the burner by the fuel feed being briefly interrupted after steady state operation of the burner for a predetermined period.

In the operating process according to the invention, after a steady state operating phase of the burner, such as partial load or full load, the fuel feed is briefly interrupted so that deposits, such as coke deposits, formed on the burner can be reduced and the burner regenerated, so that a premature burner failure because of carbonization can be prevented. This carbonization phenomenon leading to burner failure occurs more markedly especially in the full load operating state of the burner and mainly with overload. Because of this possibility of regenerating the burner, provided by the brief interruption of the fuel feed, a possibility in which the deposits formed in the burner can be reduced, the service life of the burner, especially a vaporizing burner, can be increased considerably.

Preferably, this interruption of the fuel feed takes place when the burner has been operated in steady state operation, for example for a predetermined period of about 5 to 20 minutes. This predetermined period, during which the steady operation of the burner is maintained in the usual way, depends on the design of the burner and/or of the heater, so that these time indications can be only approximate values. Further, the period of steady state operation also depends on the type of liquid fuel, such as diesel or gasoline.

Preferably, the fuel feed is interrupted for about 5 to 25 seconds so that, during this relatively brief time of fuel feed interruption, the otherwise usual operational control course of such a heater can continue undisturbed, i.e., it is not necessary to regulate and restart the heater.

To achieve this fuel feed interruption, the work cycle of the fuel feed and metering pump can be interrupted, which can be achieved, in a suitable embodiment, by an appropriate design of the control device of the heater. According to an alternative embodiment, the fuel feed interruption can also be achieved by closing a solenoid valve placed between the fuel feed and metering pump and the burner.

Preferably, the steady state operation of the burner in the operating process according to the invention involves the full load operating state; but, the partial load state can also be involved. The operating process according to the invention, in which steady state operation is based on the full load operating state, is preferably applied in vaporization burners fed with diesel fuel as a liquid fuel, thus to counteract a carbonization to the greatest possible extent.

These and other objects, features and advantages of the present invention will be apparent from the following detailed description of a preferred embodiment when viewed in conjunction with the accompanying drawing.

DETAILED DESCRIPTION OF THE PREFERRED EMBODIMENTS

Figure 1:
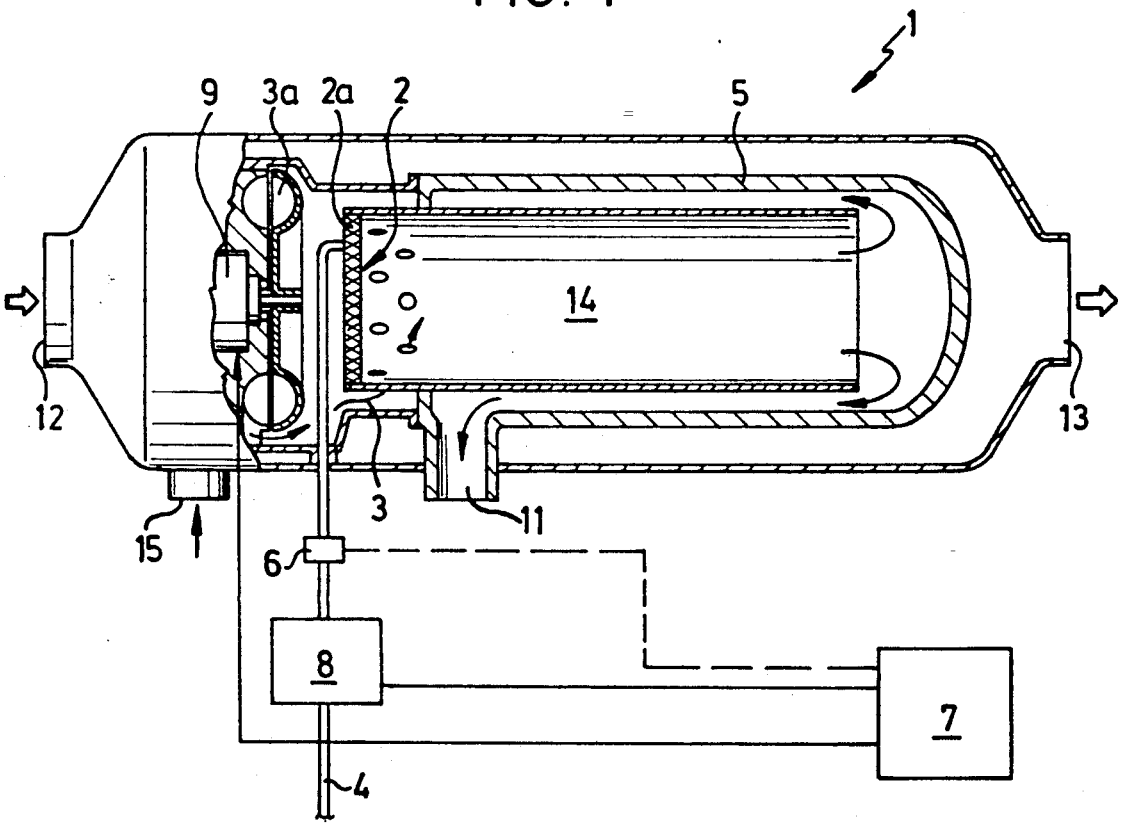
FIG. 1 is a diagrammatic view of a heater with a vaporizing burner to clarify the operating process according to the invention.

As an example, a so-called air heater is shown in FIG. 1, in which air is used as a gaseous heat transfer medium. Of course, the operating process according to the invention can also be realized in a heater operated with a liquid heat transfer medium, such as engine coolant.

The heater is designated overall in FIG. 1 by 1. Heater 1 has a burner 2 that is made, for example, of a vaporization burner that includes an absorbent element 2*a*. Combustion air 3 is fed to burner 2 by a combustion air fan 3*a* and fuel is fed to burner 2 by a fuel feed line 4 in which a fuel feed and metering pump 8 is provided with a downstream solenoid valve 6. At burner 2, a combustible mixture is produced that is burned in a combustion chamber 14 of heater 1. The hot combustion gases thus produce heat which is transferred to the heat exchange medium in a heat exchanger 5, with air that enters heater 1 through heating air intake 12 serving as a heating medium. The heating exits heater 1 through a heating air outlet 13 after sweeping over heat exchanger 5, as is indicated with arrows. Combustion air fan 3*a* draws in ambient air through an intake 15. After going through heat exchanger 5, the exhaust gases exit heater 1 by an exhaust gas outlet 11. To control the operational course of heater 1, a control device 7 is provided that is operationally connected with a drive motor 9 of combustion air fan 3*a*, with fuel feed and metering pump 8 and with solenoid valve 6, as well as other components. As described so far, heater 1 is of a design that is known in the art.

Figure 2:
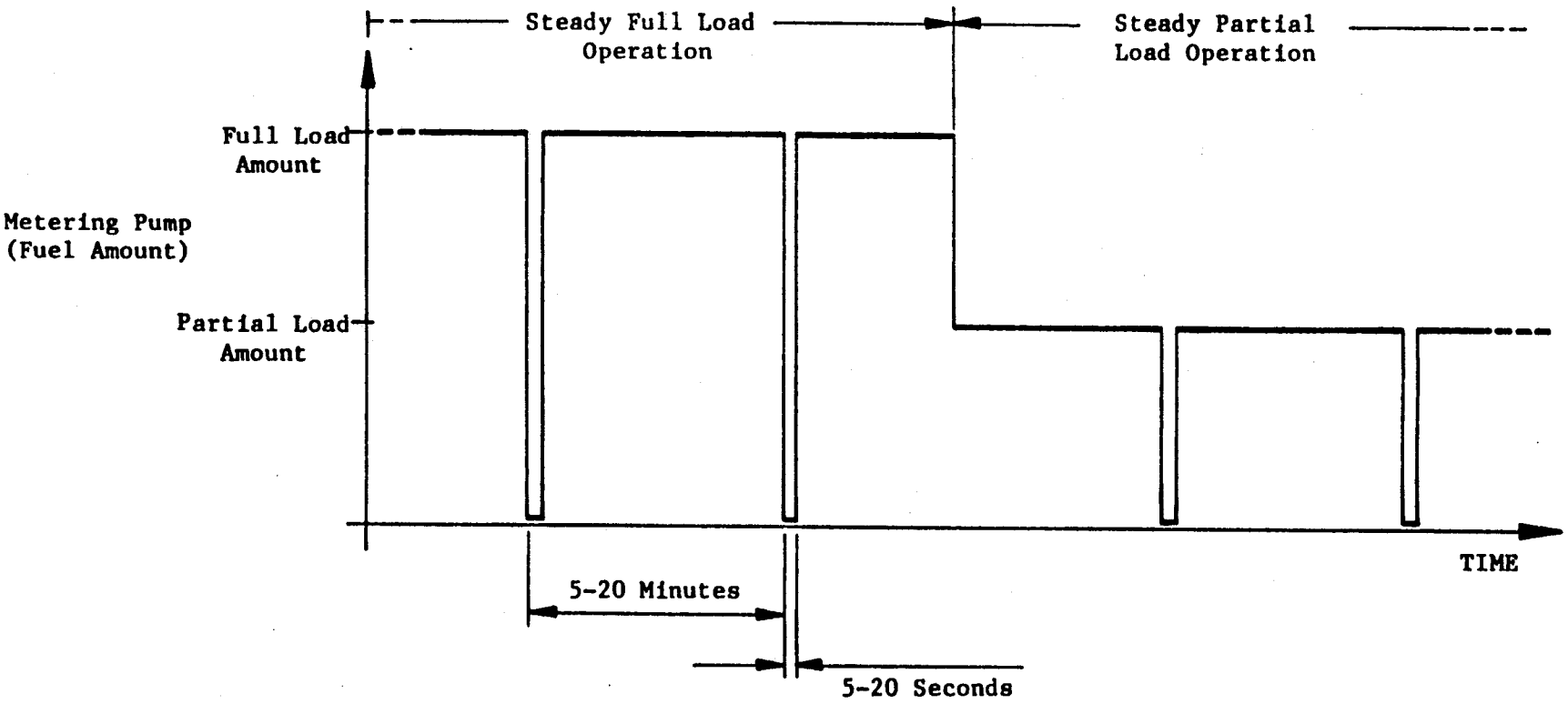
FIG. 2 is a diagram illustrating the fuel supply quantity provided according to the invention as a function of time.

The operating process according to the invention will now be explained with reference to FIG. 2 of the drawing.

If, for example, with the help of a timer that can be integrated into control device 7 of heater 1, it is determined that burner 2 has operated for a predetermined period, about 5 to 20 minutes, in steady state operation, for example, in partial load operation or full load operation, then, the work cycle of the fuel feed and metering pump 8 is interrupted, such as by suitable control signals that preferably are supplied by control device 7 of heater 1. As shown in dashed lines, control device 7 can, alternatively, close solenoid valve 6, which is placed in fuel feed line 4 between fuel feed and metering pump 8 and absorbent element 2*a* of burner 2.

With the help of the above-explained measures, it is achieved, in both cases, that the fuel feed to burner 2 is interrupted, and specifically, for example, for about 5 to 25 seconds. Furthermore, as reflected in FIG. 2, the interrupting of the fuel feed is repeated in a continuing sequence at predetermined intervals of from 5–20 minutes. With this fuel interruption, deposits on burner 2, not represented in more detail in the drawing, in particular on the surface of absorbent element 2*a* facing combustion chamber 14, can be reduced so that burner 2 can be at least partially regenerated during steady state operation. The service life of burner 2 can be considerably increased by these measures of the operating process according to the invention. The time diagram according to FIG. 2 illustrates the working phases of metering pump 8 and the amounts it conveys in the partial load range and the full load range.

Of course, the invention is not limited to the above details explained with reference to the drawings, and numerous changes and modifications are possible which one skilled in the art will be able to make without departing from the inventive concept. In particular, the operating process according to the invention can also be used with other burner types, such as atomizing burners, or the like. The operating process according to the invention can also be achieved with other heaters, such as add-on, auxiliary motor vehicle heaters to increase the service life of the burner of such heaters. In particular, it is essential with the operating process according to the invention that deposits, such as coke deposits on burner 2, are reduced by the fuel feed being interrupted during one of the steady operating states of burner 2 in which such deposits can be eliminated as much as possible, for example, by being burned off.

What is claimed:

1. Process for operating a liquid fuel fed burner having an operations control device, comprising the steps of producing an ignitable combustion mixture of air and fuel utilizing a feed and metering pump to supply fuel to the burner; and reducing deposits formed on the burner by briefly interrupting the fuel feed for about 5 to 25 seconds after a steady state operation of the burner for a predetermined period, said interrupting step being performed on a time-governed basis independent of burner temperature as part of a continuous sequence of interrupting and starting of the fuel feed by the operations control device at predetermined intervals.

2. Process according to claim 1, wherein the predetermined period of steady state operation, after which the fuel feed is briefly interrupted, is about 5 to 20 minutes.

3. Process according to claim 2, wherein the interrupting of the fuel feed is performed by interrupting operation of the fuel feed and metering pump.

4. Process according to claim 3, wherein the interrupting of the fuel feed and metering pump is performed by the operations control device.

5. Process according to claim 2, wherein the interrupting of the fuel feed is performed by a solenoid valve located between the fuel feed and metering pump and the burner.

6. Process according to claim 5, wherein the steady state operation, during which the fuel feed is interrupted, is a full load operating state.

7. Process according to claim 3, wherein the steady state operation, during which the fuel feed is interrupted, is a full load operating state.

8. Process according to claim 2, wherein the steady state operation, during which the fuel feed is interrupted, is a full load operating state.

9. Process according to claim 1, wherein the steady state operation, during which the fuel feed is interrupted, is a full load operating state.

10. Process according to claim 1, wherein the steady state operation, during which the fuel feed is interrupted, is a partial load operating state.

11. Process according to claim 10, wherein the burner is supplied with diesel fuel as the liquid fuel.

12. Process according to claim 9, wherein the burner is supplied with diesel fuel as the liquid fuel.

13. Process according to claim 2, wherein the steady state operation, during which the fuel feed is interrupted, is a partial load operating state.

14. Process according to claim 3, wherein the steady state operation, during which the fuel feed is interrupted, is a partial load operating state.

* * * * *